US007618217B2

(12) United States Patent
Henderson

(10) Patent No.: US 7,618,217 B2
(45) Date of Patent: Nov. 17, 2009

(54) POST-TENSION PILE ANCHOR FOUNDATION AND METHOD THEREFOR

(76) Inventor: Allan P. Henderson, 1965 Airport Dr., Bakersfield, CA (US) 93308

( * ) Notice: Subject to any disclaimer, the term of this patent is extended or adjusted under 35 U.S.C. 154(b) by 0 days.

(21) Appl. No.: 11/797,772

(22) Filed: May 7, 2007

(65) Prior Publication Data

US 2007/0269273 A1 Nov. 22, 2007

Related U.S. Application Data

(63) Continuation-in-part of application No. 10/734,281, filed on Dec. 15, 2003.

(60) Provisional application No. 60/797,746, filed on May 5, 2006.

(51) Int. Cl.
*E02D 27/00* (2006.01)

(52) U.S. Cl. ..... 405/255; 52/294; 52/295; 52/296; 405/239; 405/251; 405/256

(58) Field of Classification Search ..... 52/223.4, 52/294–296, 741.1, 741.14, 741.15; 405/233, 405/236, 239, 249, 251, 256
See application file for complete search history.

(56) References Cited

U.S. PATENT DOCUMENTS 1,048,993 A * 12/1912 Meriwether ..... 405/253
2,162,108 A * 6/1939 Newman ..... 405/239
2,374,624 A * 4/1945 Schwendt ..... 52/223.5
2,706,498 A * 4/1955 Upson ..... 285/290.4
2,724,261 A * 11/1955 Rensaa ..... 52/295
3,186,181 A * 6/1965 Snow et al. ..... 405/233
3,382,680 A * 5/1968 Takano ..... 405/252
3,559,412 A * 2/1971 Fuller ..... 405/237
3,600,865 A * 8/1971 Vanich ..... 52/73
3,793,794 A * 2/1974 Archer et al. ..... 52/632
3,839,874 A * 10/1974 Wyant ..... 405/233
3,842,608 A 10/1974 Turzillo
3,916,635 A * 11/1975 Lynch et al. ..... 405/253
3,963,056 A 6/1976 Shibuya et al.
3,963,065 A 6/1976 Dauwalder
4,038,827 A 8/1977 Pryke
4,060,994 A * 12/1977 Chitis ..... 405/238
4,217,738 A 8/1980 Smith
4,228,627 A 10/1980 O'Neill
4,232,846 A 11/1980 Bressani
4,287,691 A 9/1981 Guenther (Continued)

FOREIGN PATENT DOCUMENTS

DE 27 58 489 11/1978

(Continued)

*Primary Examiner*—Tara Mayo-Pinnock
(74) *Attorney, Agent, or Firm*—Jacobson Holman PLLC

(57) ABSTRACT

A post-tensioned pile anchor foundation and method therefor creates a void or highly compressible region between a drilled or driven pile anchor surrounding a post-tensioned anchor bolt or tendon and the bottom of a foundation cap. The void or compressible region can be formed by compressible spacers or void forming elements placed between the top of the pile anchor and the concrete cap. As the anchor bolt or tendon is post-tensioned against the cap, the void forming element is compressed or crushed, allowing the cap to be pulled downwardly and the pile anchor to be pulled upwardly toward the cap against the resistance of the surrounding soil.

21 Claims, 11 Drawing Sheets

U.S. PATENT DOCUMENTS

| | | | | |
|---|---|---|---|---|
| 4,618,287 | A | | 10/1986 | Kinnan |
| 4,842,447 | A | | 6/1989 | Lin |
| 4,910,940 | A | | 3/1990 | Grady, II |
| 5,131,790 | A | | 7/1992 | Simpson |
| 5,228,806 | A | | 7/1993 | De Medieros, Jr. et al. |
| 5,231,808 | A | | 8/1993 | Angelette |
| 5,289,626 | A | * | 3/1994 | Mochida et al. ..... 29/452 |
| 5,379,563 | A | | 1/1995 | Tinsley |
| 5,474,399 | A | * | 12/1995 | Chia-Hsiung ..... 405/229 |
| 5,586,417 | A | | 12/1996 | Henderson et al. |
| 5,625,988 | A | | 5/1997 | Killick |
| 5,678,382 | A | | 10/1997 | Naito |
| 5,761,875 | A | | 6/1998 | Oliphant et al. |
| 5,826,387 | A | | 10/1998 | Henderson et al. |
| 5,878,540 | A | | 3/1999 | Morstein |
| 5,960,597 | A | | 10/1999 | Schwager |
| 6,119,425 | A | | 9/2000 | Shimonohara |
| 6,216,414 | B1 | | 4/2001 | Feldberg |
| 6,270,308 | B1 | | 8/2001 | Groppel |
| 6,665,990 | B1 | * | 12/2003 | Cody et al. ..... 52/295 |
| 6,672,023 | B2 | | 1/2004 | Henderson |

FOREIGN PATENT DOCUMENTS

| | | |
|---|---|---|
| FR | 1463696 | 3/1967 |
| FR | 2030478 | 11/1970 |
| JP | 55 122916 | 9/1980 |
| JP | 58 166195 | 10/1983 |
| JP | 59 150830 | 8/1984 |
| JP | 61 233131 | 10/1986 |
| JP | 6 316942 | 11/1994 |

* cited by examiner

POST-TENSION PILE ANCHOR FOUNDATION AND METHOD THEREFOR

This application claims the benefit of priority to U.S. Provisional Patent Application No. 60/797,746 filed May 5, 2006, and is a continuation-in-part of copending U.S. application Ser. No. 10/734,281, filed Dec. 15, 2003, the subject matter of which is expressly incorporated herein by reference as if fully set forth in its entirety (hereinafter referred to as the '281 application").

BACKGROUND OF THE INVENTION

1. Field of the Invention

The present invention is related to the field of pile anchor foundations and, more particularly, to a post-tensioned pile anchor foundation including a post-tensioned foundation cap and a plurality of post-tensioned pile anchors extending vertically downward therefrom and a method of constructing such a post-tensioned pile anchor foundation.

2. Description of the Related Art

In a normal pile foundation, the piles extend to or into the above concrete foundation and are only compression resisting foundation extensions. Such pile foundations are not post-tensioned.

When tall, heavy and/or large structures are constructed, a post-tensioned concrete foundation is desirable in order to provide improved rotational stiffness, minimized movement from dynamic forces, and increased foundation frequency to approach the frequency of a rigid body. Such concrete foundations are particularly useful for the support of tall, heavy and/or large towers which may be used to support wind turbines, power lines, street lighting and signals, bridge supports, commercial signs, freeway signs, ski lifts and the like.

Various different forms of concrete foundations utilizing post-tensioned reinforcement and operational features of the instant invention have heretofore been disclosed in my earlier U.S. Pat. Nos. 5,586,417, 5,826,387 and 6,672,032, the disclosures of which are expressly incorporated herein in this application by reference as if fully set forth in their entirety. However, the concrete foundations of my aforesaid patents do not relate to pile anchor foundations. Therefore, a need exists for a pile anchor foundation that allows for the pile anchors to be post-tensioned.

SUMMARY OF THE INVENTION

The foundation of the instant invention resists supported structure overturn by a multitude of circumferentially spaced post tensioned pile anchors driven, drilled or otherwise formed into the subsurface soil. The pile anchors are constructed below a foundation concrete cap which is used to support a tower or other structure that is attached to the upper surface of the concrete cap.

Each pile anchor includes a post-tensioning element, such as a tendon or bolt, that extends through a pile anchor base plate and the concrete cap, and then centrally into a pile hole. The pile hole can be formed in various ways known in the art, such as drilling, mandrel driving, etc. Each pile hole is filled with cementious material around the tendon or bolt to secure the pile anchors into the ground.

The embedded portion of the tendon or bolt includes a lower end and an upper end. The lower end of the bolt is bare, i.e., is in direct contact with the cementious material, for bonding with the cementious material in a bottom portion of the pile anchor. One or more end nuts may be provided on the bolt lower end to facilitate bonding of the bolt lower end with the cementious material. Preferably, one or more centralizers center the tendon or bolt in the drilled pile hole.

The upper end of the embedded portion of the bolt is encased, preferably in a plastic sleeve or the like, and most preferably in a polyvinyl chloride (PVC) tube, so that the upper end of the bolt does not bond to the cementious material in the upper portion of the drilled pile hole. The sleeve also extends upwardly through the cap so that the tendon or bolt is also prevented from bonding to the cementious material of the cap. Such encased bolts in post-tensioned concrete foundations are disclosed in my earlier aforesaid U.S. Pat. Nos. 5,586,417 and 5,826,387.

After the cementious material has been poured or pumped, such as through a hollow stemmed auger, into the drilled pile holes and allowed to cure to fix the pile anchor tendons or bolts in the ground, a void or space is created above the top of each filled pile hole or pile anchor and into the adjacent lower surface of the foundation cap or leveling course. One technique to form the requisite void or space is to insert a spacer or void forming element. The spacer or void forming element thus defines a hollow area between the top of each pile anchor and the adjacent bottom of the foundation cap. The spacer or void forming element is provided with an aperture, preferably generally cylindrical, through which the sleeved tendon or bolt extends before passing through the cap. A second technique would be to form a collapsible zone with a highly compressible material similar to Styrofoam or equivalent.

The uppermost end of the tendon or bolt which protrudes from the top of the cap is fitted with the pile anchor base plate and a post-tensioning nut threaded thereon to post-tension the pile anchor and the concrete cap after the cementious material of the cap has hardened. The compressible material, spacer or void forming element is compressed or crushed by the post-tensioning, allowing the pile anchor to pull upward until skin friction resistance with the surrounding soils equaling the required tendon tension is achieved. The required bolt or tendon tension should exceed the maximum structure uplift load determined for each pile anchor.

In view of the foregoing, it is an object of the present invention to provide a concrete foundation for tall, heavy and large structures, such as support towers, which foundation is secured with post-tensioned pile anchors.

Another object of the present invention is to provide a pile anchor foundation in accordance with the preceding object which includes a concrete cap positioned above the pile anchors and which allows the pile anchors to be pulled upwardly and the foundation cap pulled downwardly to develop soil resistance for both of the post-tensioned elements.

Still another object of the present invention is to provide a pile anchor foundation in accordance with the preceding objects which includes a plurality of tendons or bolts that extend into each of the pile anchors with their lower end bonded to the pile anchor cementious material and the upper end extending through to above the top of the foundation cap, which upper end is free to move within the upper portion of the pile anchor and the foundation cap for post-tensioning.

A further object of the present invention is to provide a post-tensioned pile anchor foundation in accordance with the preceding objects which includes a void or spacing defining a hollow area between the top of each pile anchor and the adjacent bottom of the foundation cap so that the top of the pile anchor is pulled upwardly toward the adjacent cap bottom and the cap is pulled downwardly against the surrounding soil during the post-tensioning of each anchor tendon or bolt.

A still further object of the present invention is to provide a post-tensioned pile anchor foundation in accordance with the preceding object in which the void or spacing is preferably formed by a compressible (including crushable) spacer or void forming element.

Still yet another object of the present invention is to provide a pile anchor foundation in accordance with the preceding objects which can be completely tested for performance and creep before installing the supported tower or other structure thereon.

Yet a further object of the present invention is to provide a post-tensioned pile anchor foundation in accordance with the preceding objects in which the foundation may be easily and quickly re-leveled if partially upset by extremely high loads, above design loads, as a result of "Acts of God", such as earthquakes, tornados or hurricanes.

Still yet another object of the present invention is to provide a pile anchor foundation which has greater flexibility to design for supporting a wide range of towers or other structures, including the addition of further weight components. The number of pile anchors can be easily increased or decreased for any particular design depending upon the design capacity of the foundation, including the addition of an inner circle of separate post-tensioned pile anchors, if desired.

A further object of the present invention is to provide a post-tensioned pile anchor foundation in accordance with the preceding objects, which can be constructed and effective in soils with long-term compressibility, where other foundations are inadequate, because long-term settlement can be addressed in the foundation of the present invention by simply re-tensioning the anchor bolts periodically.

A further object of the present invention is to provide a post-tensioned pile anchor foundation in accordance with the preceding objects which can be constructed and operate effectively in storm surge, flood, scour, erosion, and seismic zones inasmuch as the foundation of the present invention is anchored and supported deep below the surface and is able to be re-tensioned.

Yet another object of the present invention is to provide a method for forming the post-tensioned pile anchor foundations recited in the preceding objects.

A final object of the present invention to be set forth herein is to provide a post-tensioned pile anchor foundation and method for construction which may be utilized in a wide range of soils from water-laden sand or clay formations to solid rock, may be formed in situ in remote locations, and will incorporate a minimum amount of concrete or other cementious materials, while providing at the same time a concrete foundation which can be maintained under heavy post-tension forces.

These together with other objects and advantages which will become subsequently apparent reside in the details of construction and operation as more fully hereinafter described and claimed, reference being had to the accompanying drawings forming a part hereof, wherein like numerals refer to like parts throughout. While intending to illustrate the invention, the drawings are not to scale.

DETAILED DESCRIPTION OF THE PREFERRED EMBODIMENTS

Figure 1:
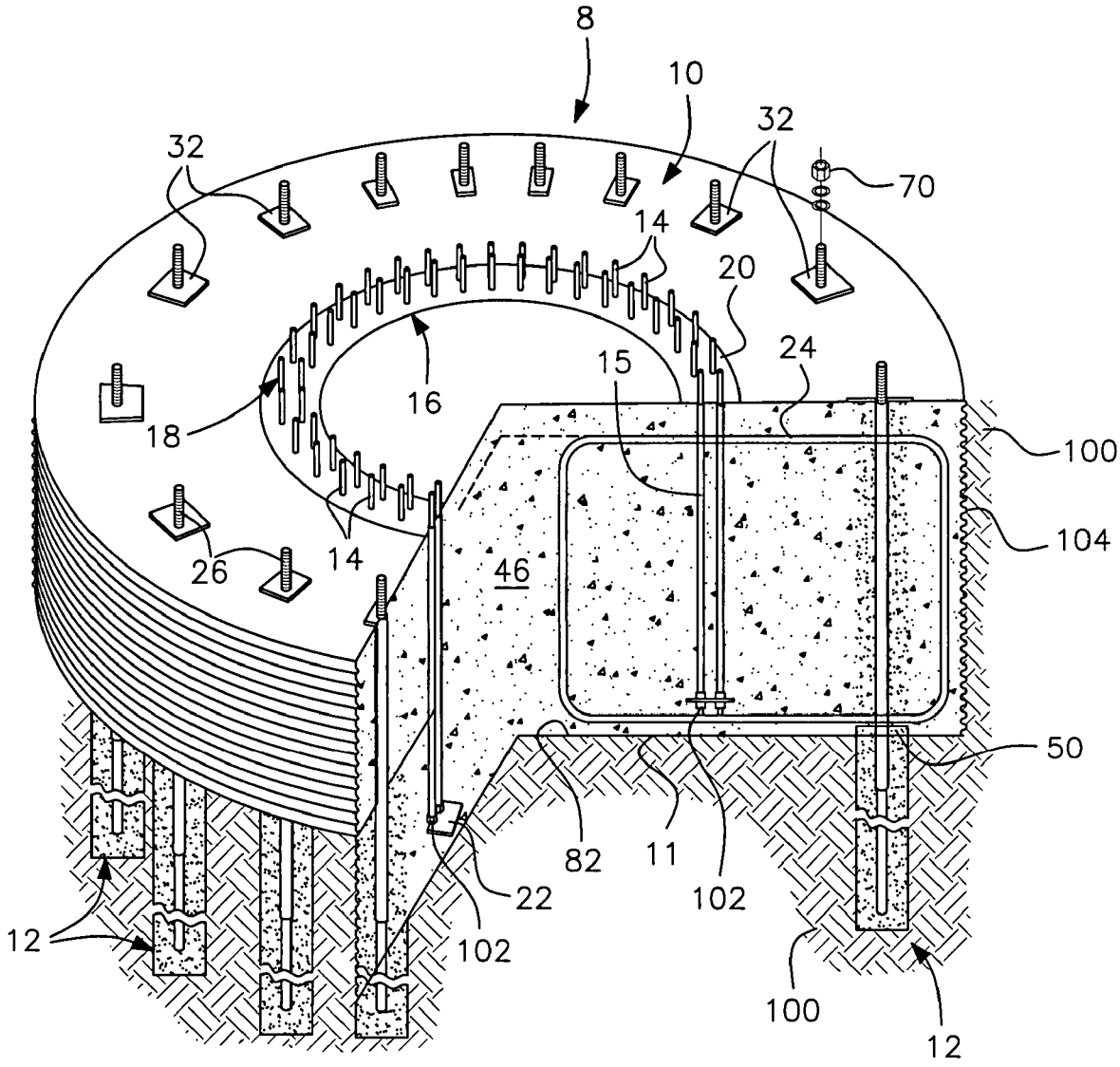
FIG. 1 is a schematic perspective and partial sectional view of a complete cap and pile anchor foundation constructed in accordance with a preferred embodiment of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

One embodiment of a pile anchor foundation according to the present invention is shown in the '281 application using corrugated metal pipes to define the perimeter wall of the anchor piles. It has been found that the pile anchors can be formed in various other ways known to those skilled in the art in order to form a post-tensioned foundation according to the present invention. Such further embodiments are illustrated and described herein.

Figure 2:
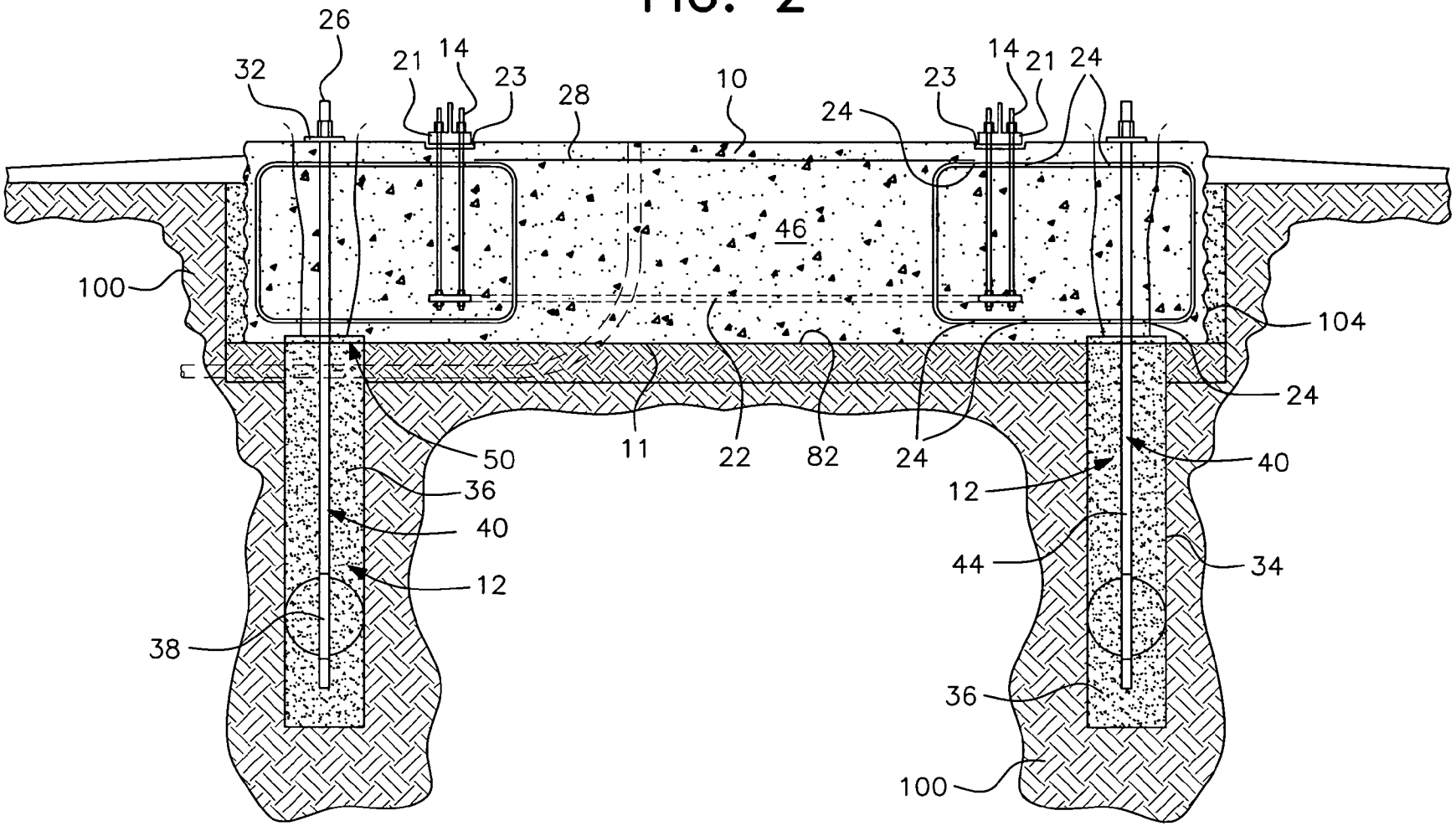
FIG. 2 is a cross-sectional side view of the complete foundation of FIG. 1 showing the concrete cap positioned above the concrete pile anchors and the bolts or tendons extending therethrough in accordance with the present invention.
Figure 3:
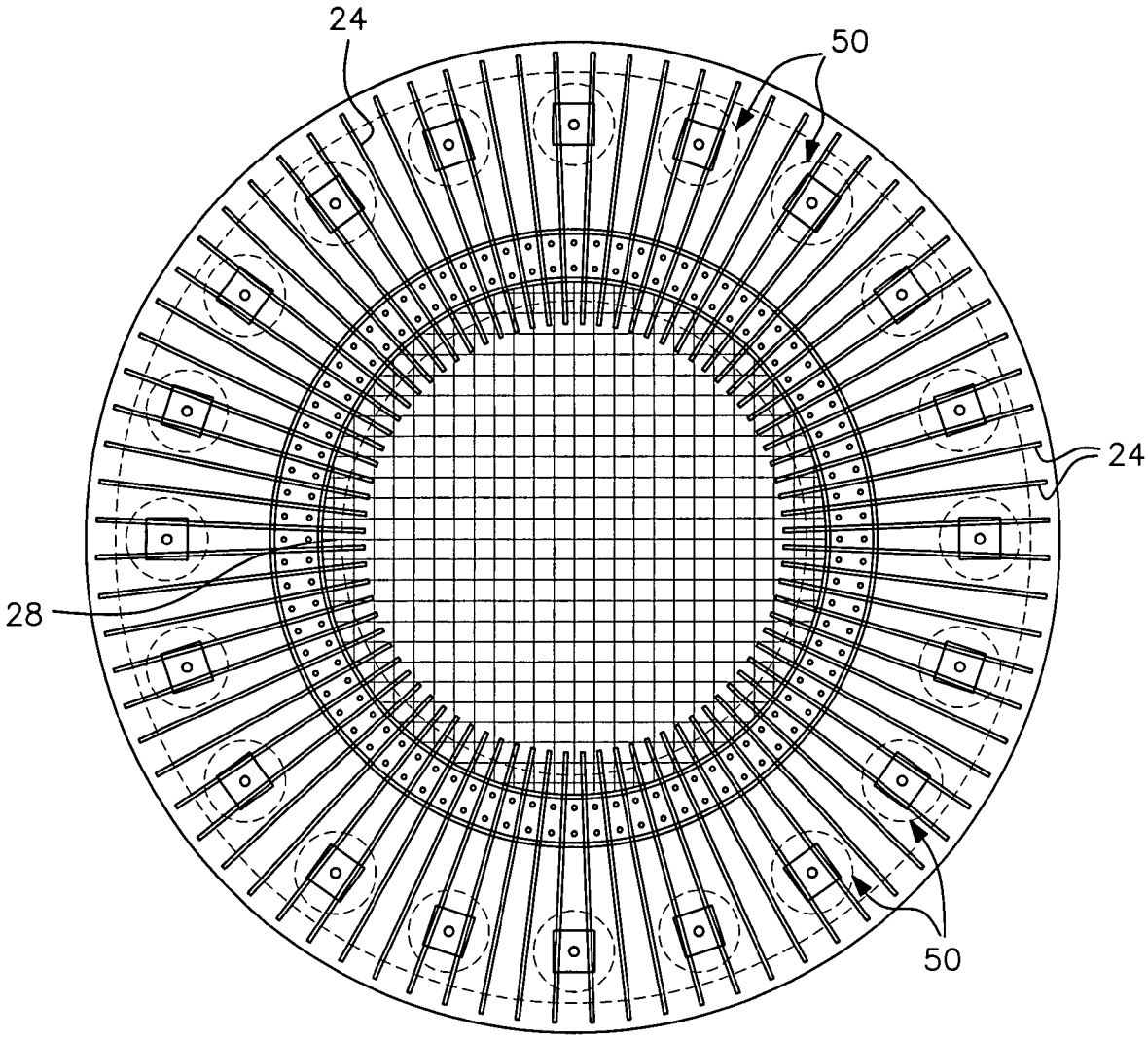
FIG. 3 is a top plan view of the cap foundation of FIG. 1 before concrete is poured.

As shown in FIGS. 1-3, another post-tensioned pile anchor foundation of the present invention, generally designated by reference numeral 8, has a circular concrete cap, generally designated by reference numeral 10. The cap 10 is made of cementious material 46 and preferably defined by corrugated metal pipe 104 around its periphery and by the soil at the bottom 82 of an excavation in a ground surface. The soil underneath the cap 10 is preferably compacted to a depth of 12 inches or more. The cap is set at or below the ground surface and a plurality of pile anchors, generally designated by the reference numeral 12 extend vertically downward into the soil 100 from the bottom 11 of cap 10. The pile anchors 12 serve to secure the concrete cap 10 into the ground.

The foundation cap 10 includes a series of tower anchor bolts 14 spaced circumferentially about the central vertical axis of the foundation cap. The tower anchor bolts 14 are preferably positioned in radial pairs forming two anchor bolt circles, generally designated by the reference numerals 16 and 18. The inner tower anchor bolt circle 16 has a slightly shorter diameter than the outer tower anchor bolt circle 18.

For example, the outer tower anchor bolt circle diameter may be about fourteen feet and the inner tower anchor bolt circle diameter may be about thirteen feet. A tower or other supported structure (not shown) can be attached to the concrete cap 10 by the tower anchor bolts 14. Structures which can be supported on the post-tension pile anchor foundation of the present invention include, but are not limited to, transmission towers, electrical towers, communication towers, lighting standards, bridge supports, commercial signs, freeway signs, ski lift supports, solar energy towers, wind turbine towers, large stacks or chimneys, silos, tank structures, airport towers, guard towers, etc.

The tower anchor bolts 14 extend through and are nutted atop a typical circular tower base flange at the bottom of the tower or other supported structure positioned and grouted in grout trough 23 in the cap upper surface. The other or bottom end of the bolts 14 extends to an embedment ring 22 near the bottom of the concrete cap. The tower anchor bolts 14 are sleeved in elongated hollow tubes 15, preferably PVC tubes, which cover the anchor bolts except for threaded portions at the top and bottom of the bolts. The anchor bolt sleeves prevent bonding of the bolts to the concrete and grout. This structure allows the tower anchor bolts to be elongated and post-stressed between the tower base flange and the embedment ring to alleviate bolt cycling and fatigue.

The lower ends of the tower anchor bolts 14 are anchored near the bottom of the concrete cap foundation with the embedment ring 22 with suitable nuts 102 or the like. The embedment ring 22 is preferably constructed of several circumferential segments lap jointed together. The embedment ring 22 is approximately the same size as and is complementary to the tower base flange 21. The ring 22 contains bolt holes for each of the tower anchor bolts. As best shown in FIG. 2, the tower base flange 21 is preferably seated in the grout trough 23.

Reinforcing steel rebar 24 is positioned radially between the pairs of tower anchor bolts 14 and pile anchor bolts 26. The radial steel rebar is preferably in the shape of rebar hoops extending both near the top and the bottom of the concrete cap foundation 10. The rebar hoops are lapped vertically and wire tied near and parallel to the cap perimeter. The rebar reinforcement, which can also include welded wire mesh 28, is intended to resist bending forces in the concrete cap 10. Other types of reinforcing steel as known by those skilled in the art can be used for the reinforcing steel rebar 24 of the concrete cap 10, such as bent rebar, headed rebar, bolts and nuts, bolts with forged bell ends, etc.

As shown in FIGS. 1 and 3, the pile anchors 12 are constructed below the foundation concrete cap 10. Each pile anchor includes an elongated pile anchor post-tensioning element, preferably a bolt or tendon 26, that extends through a pile anchor base plate 32 on the top surface of or preferably grouted into the concrete cap 10, then through the concrete cap 10, and finally into a drilled pile hole 34 that is filled with pile anchor cementious material 36 to secure the pile anchors in the ground or soil 100.

The embedded portion of the tendon or bolt 26 includes a lower end 38 and an upper end, generally designated by the reference numeral 40. The lower end 38 of the bolt is bare, i.e., is in direct contact with the cementious material 36, for bonding thereto when the material 36 is poured or pumped to fill the interior of the drilled pile holes 34. The cementious material 36 preferably fills the pile holes 34 to the bottom 82 of the excavation area. An end nut 42 may be provided on the lower end of the bolt 26 (see, for example, FIGS. 5 and 6) to facilitate bonding of the bolt lower portion 38 with the cementious material 36.

The upper end 40 of the embedded portion of the bolt 26 is encased in an elongated hollow tube, preferably in a plastic sleeve 44 or the like, and most preferably by PVC tubing, along a major upper portion of its length, to prevent bonding with the cementious material 46 of the concrete foundation cap 10 and the pile anchor cementious material 36 and to allow for post-tension stretching. A centralizer 84 is preferably mounted around the lower portion 38 of the anchors 26 so as to position the pile anchor bolt 26 centrally within the pile hole 34.

As stated previously, the hollow tubes 15 and plastic sleeve 44 for encircling or encasing the anchor bolts 14 and the elongated pile anchor bolts 26, respectively, are preferably made of PVC tubing. The plastic sleeves or tubing shield the bolts and prevent them from adhering to the cementious material. As such, the bolts can be tensioned after the cementious material has hardened and cured in order to post-tension the pile anchors and the foundation cap of the present invention. Alternately, the bolts can be wrapped in plastic tape, or otherwise sheathed, to prevent the bolts from adhering to the cementious material during curing and allow the bolts to stretch freely under tension over the entire sheathed length of the bolts.

Figure 4A:
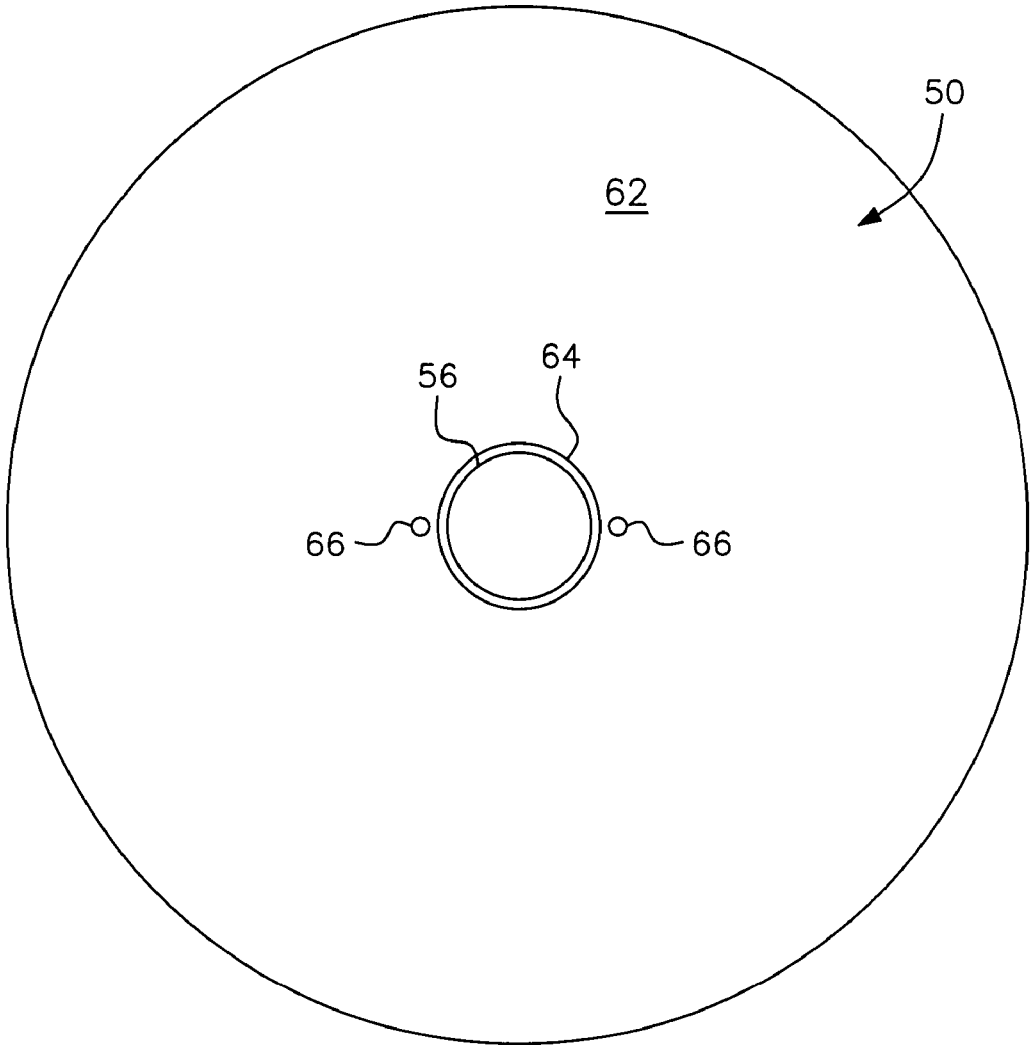
FIG. 4A is a top plan view of one embodiment of a void forming element for the completed cap and pile anchor foundation of FIG. 1.
Figure 4B:
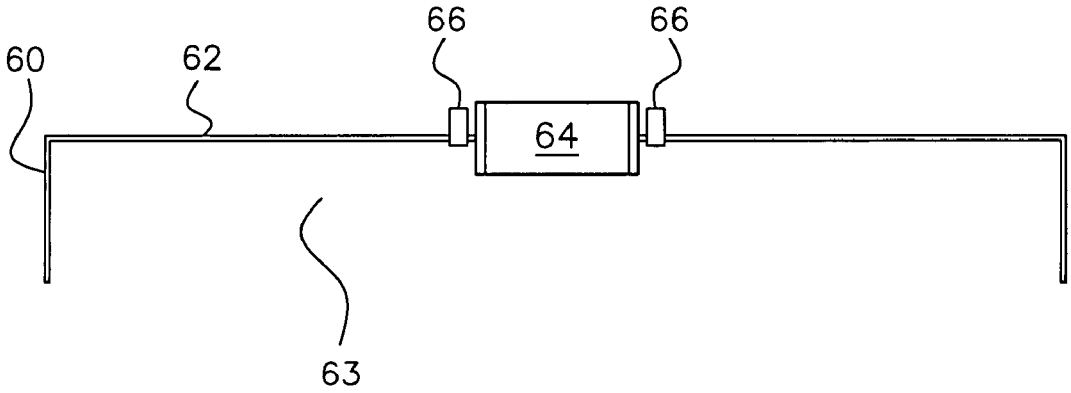
FIG. 4B is a section view of the void forming element of FIG. 4A.

After the cementious material 36 has been poured into the drilled pile holes 34 to fix the pile anchor tendons or bolts 26 in the ground 100, a void or highly compressible area 54 is formed between the top of the pile anchor cementious material 36 and the adjacent lower surface 52 of the cementious material 46 of the concrete foundation cap 10. The void 54 is preferably formed using a compressible (including crushable) spacer or void forming element generally designated by the reference numeral 50, which is inserted between the top of each filled pile hole 34 and the adjacent lower surface 52 of the cap 10 to be formed. One embodiment of the void forming element 50 is representatively shown in FIGS. 4A and 4B. The void forming element defines a void or hollow area 54 above each pile anchor 12 and is provided with a generally circular aperture 56 through which the sleeved tendon or bolt 26 extends before passing through the cap 10. The void forming element 50 is made to slide down the bolt 26 to sit on the bottom of the excavation area over the top of each filled pile anchor cementious material 36.

As shown in FIGS. 4A, 4B and 5-9, the void forming element 50 can be a molded plastic form made of any suitable polymer material and having an upstanding peripheral wall 60, an upper surface 62 and an open bottom 63. Alternatively, the void forming element 50 can be constructed as a hollow disc or as a compressible disc, such as a disc made of expanded polyurethane or of styrofoam. The element 50 can be virtually any natural or man-made material that is highly compressible or crushable under 10 psi pressure or greater and which allows the concrete cap foundation 10 to be pulled downwardly compressing and consolidating the underlying soils 100 to the required bearing strengths and allowing the pile anchors 12 to be pulled upwardly to develop the skin friction resistance equal to the pile anchor bolt or tendon post-tension.

The void forming element 50 may also be constructed as an inflatable or pressurized bladder which will allow the pile anchor 12 to be pulled upwardly and the foundation cap 10 be pulled downwardly by tensioning the anchor bolts 26. As a further construction, the void forming element 50 can be made of a material that will develop great compressive strength when contacted with a catalyst after tensioning the anchor bolt or tendon. This embodiment includes materials in which the development of such compressive strength can be retarded for days.

As further shown in FIGS. 4A, 4B, and 5-9, the void forming element 50 is preferably provided with a generally cylindrical coupling component 64 that defines the circular aperture 56 and which assists in enabling the void forming element to slide down the anchor bolt 26. According to one preferred embodiment, this coupling component 64 may be embodied as a piece of PVC pipe approximately four inches in diameter and two inches in length.

According to the embodiment shown in FIGS. 4A, 4B and 5-9, at least one and preferably two smaller generally cylindrical tube couplers 66 may be located adjacent the coupling component 64. These smaller tube couplers 66 communicate with the hollow space 54 created by the void forming element 50 and are each attached to a grout tube 68, one tube acting as an inlet and the other tube acting as an outlet. The grout tubes 68 extend upwardly from the tube couplers 66 along the length of the sleeved bolt or tendon 26 to its uppermost end. Following post-tensioning, grout or other cementious material may be forced into the inlet grout tube to fill any remaining void space not eliminated by the crushing of the void form. When grout is forced through the inlet tube to the void space and begins to exit from the grout outlet tube, this indicates that any remaining void space has been filled. This grout tube construction is optional, however, and is not necessary to the effectiveness of the present invention.

The uppermost end of the tendon or bolt 26 which protrudes from the top of the cap 10 is fitted with a pile anchor base plate 32 and a post-tensioning nut 70 is threaded onto the tendon or bolt to post-tension the pile anchor 12 and the concrete cap 10 after the cementious material 46 of the cap has hardened. The void created by the void forming element 50 is compressed and element 50 is crushed by the post-tensioning, allowing the pile anchor 12 to pull upwardly until skin friction resistance with the surrounding soils equaling the required tendon tension is achieved. The required bolt or tendon tension exceeds the maximum structure uplift load determined for each pile anchor.

Figure 5:
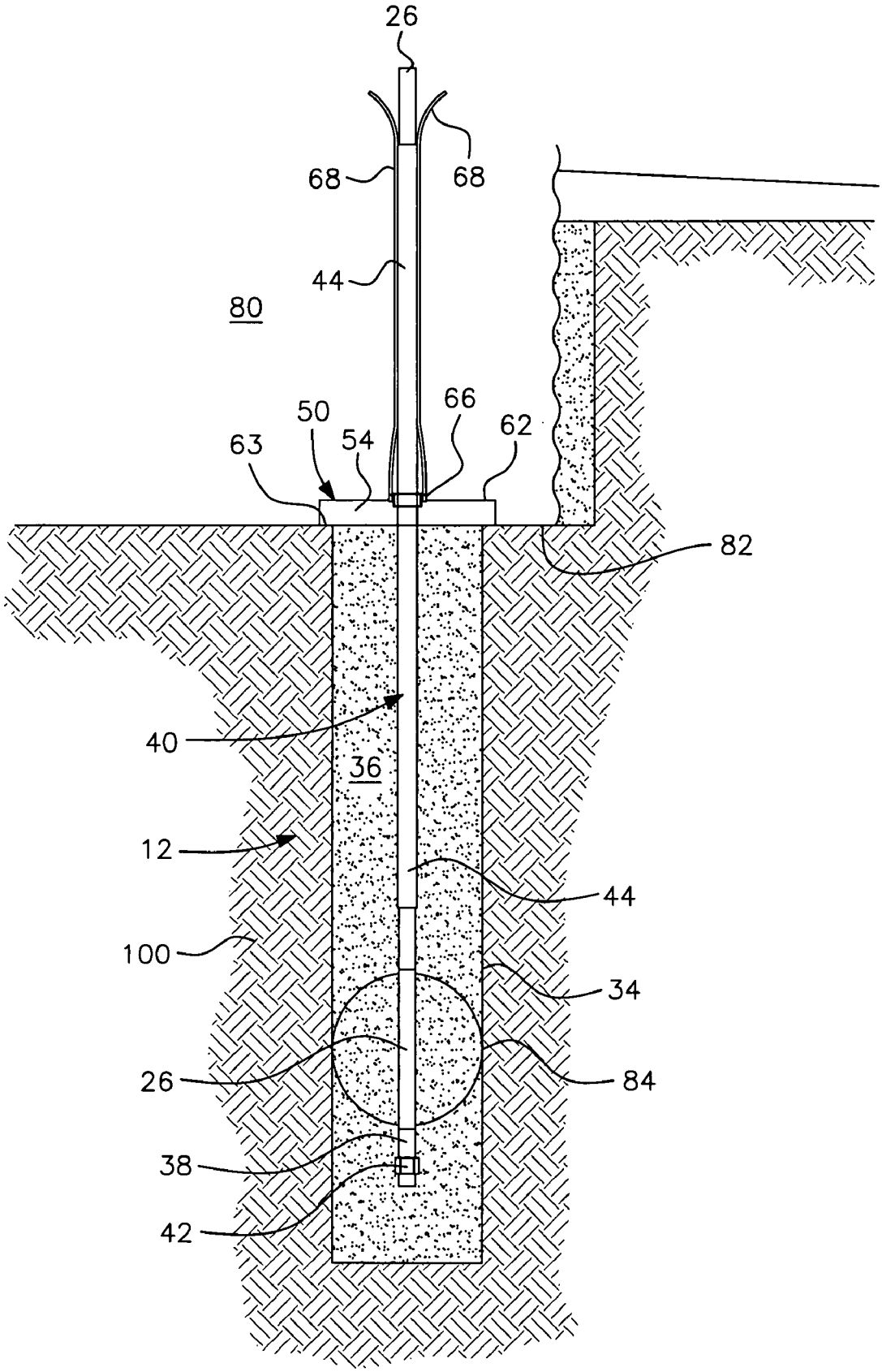
FIG. 5 is a partially sectioned side view of a first step in forming the completed foundation with the concrete cap and pile anchors as shown in FIG. 1.

The steps undertaken to form the completed foundation of FIG. 1 can be described with reference to FIGS. 5-9 as follows. As shown in FIG. 5, first an area 80 is excavated having a depth generally corresponding with the intended thickness of the cap 10 and leveling course. Representatively, this area 80 has a depth of about 4 feet. Within the excavation area 80 and starting from the bottom 82 thereof, a plurality of spaced pile holes 34 are drilled or driven. These pile holes 34 typically have a diameter of about 18-36 inches and a depth from about 30 feet to about 50 feet. In the representation illustrated in the drawings, the pile holes are 24 inches in diameter and 40 feet deep, and twenty pile holes 34 are formed. After the pile holes 34 are formed, pile anchor bolts or tendons 26 are inserted therein. The pile anchor bolts or tendons 26 are preferably fitted with centralizers 84 to maintain their position in the center of the pile holes in preparation for the pouring of the cementious grout or material therein. When the tendons or bolts 26 have been centered in the pile holes 34, cementious material 36 is poured or pumped therein up to the bottom 82 of the excavation area 80. Alternatively, the bolts 26 and centralizers 84 can be inserted after the cementious material 36 is in the pile holes 34. After the cementious material 36 for the pile anchors has hardened, the void forming element or plastic void form 50 is inserted over the top of the bolt 26 and positioned over the top of the anchor pile cementious material 36 at the bottom 82 of the excavation area 80.

Figure 6:
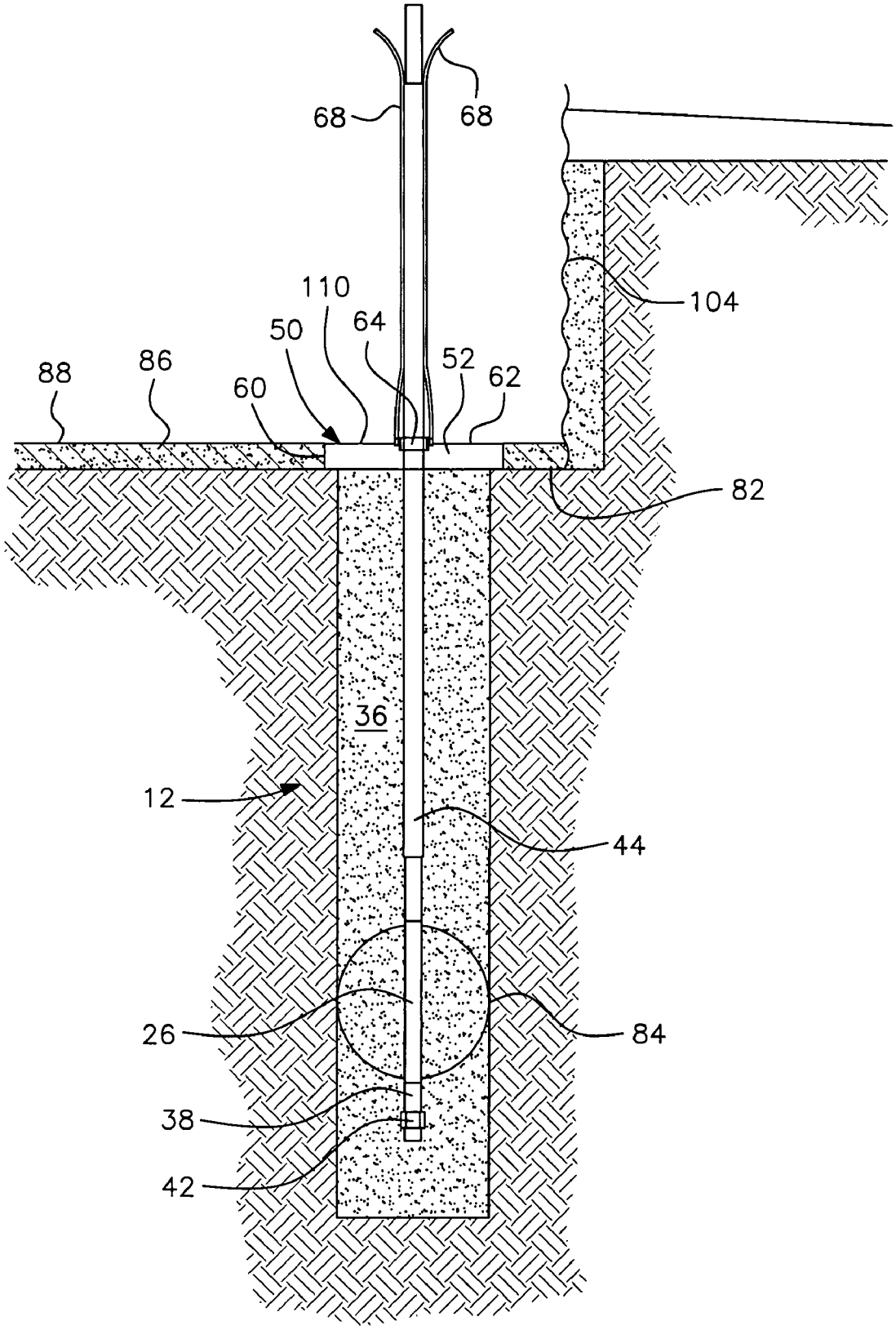
FIG. 6 is a partially sectioned side view of a second step in forming the completed foundation following the first step of FIG. 5.

The next step in forming the foundation is illustrated in FIG. 6. With the void forming elements 50 in place, a concrete leveling course 86 is laid on the bottom 82 of the excavation area 80. In the representative embodiment illustrated, the leveling course 86 is approximately four inches in depth to correspond with the height of the void forming element 50 as shown. Of course, different thicknesses of the leveling course 86 can be used to accommodate void forming elements of different thicknesses. Preferably, the top surface 110 of the void forming elements 50 should be substantially flush with the upper surface 88 of the leveling course 86.

Figure 7:
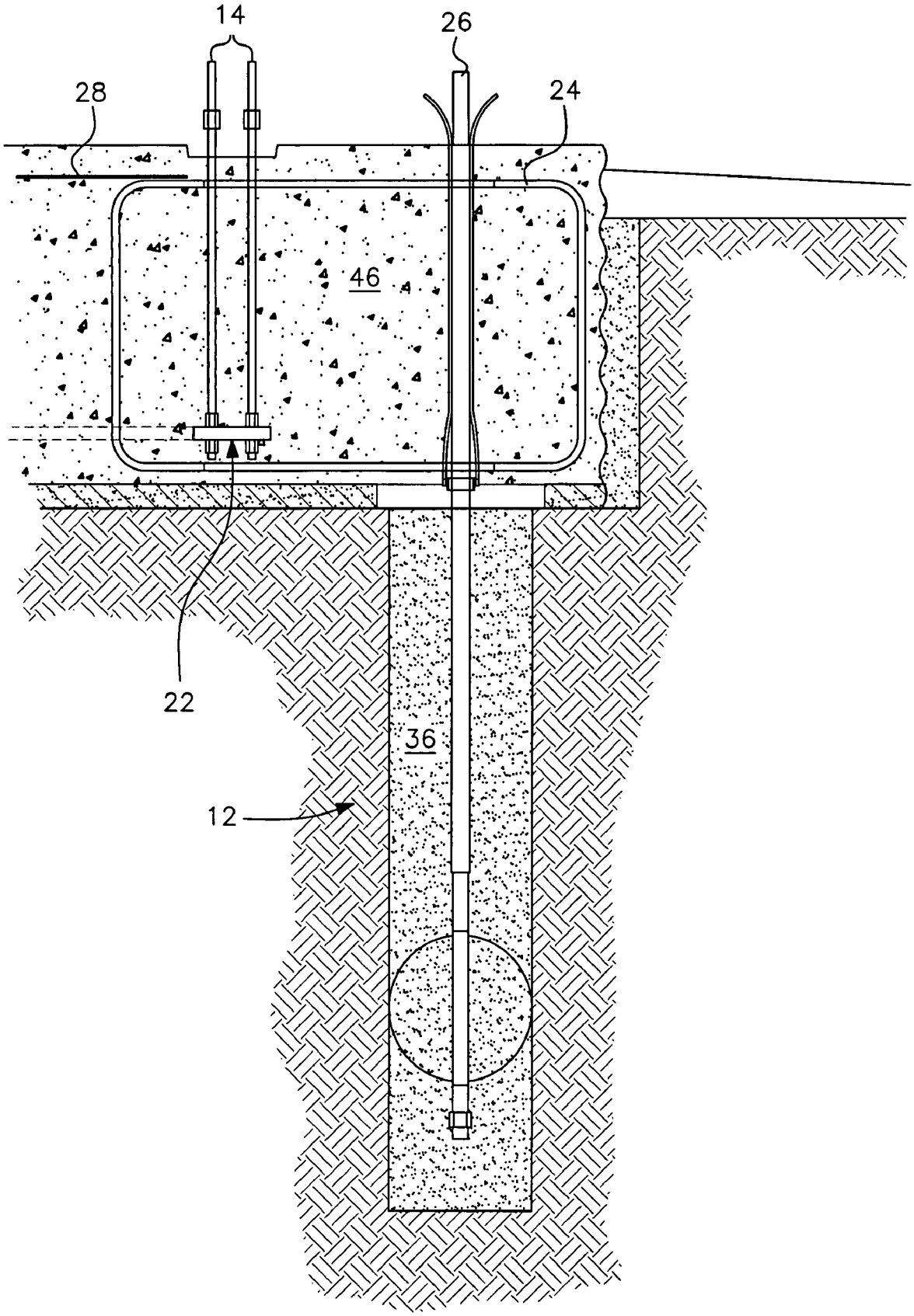
FIG. 7 is a partially sectioned side view of a third step in forming the completed foundation following the second step of FIG. 6.
Figure 8:
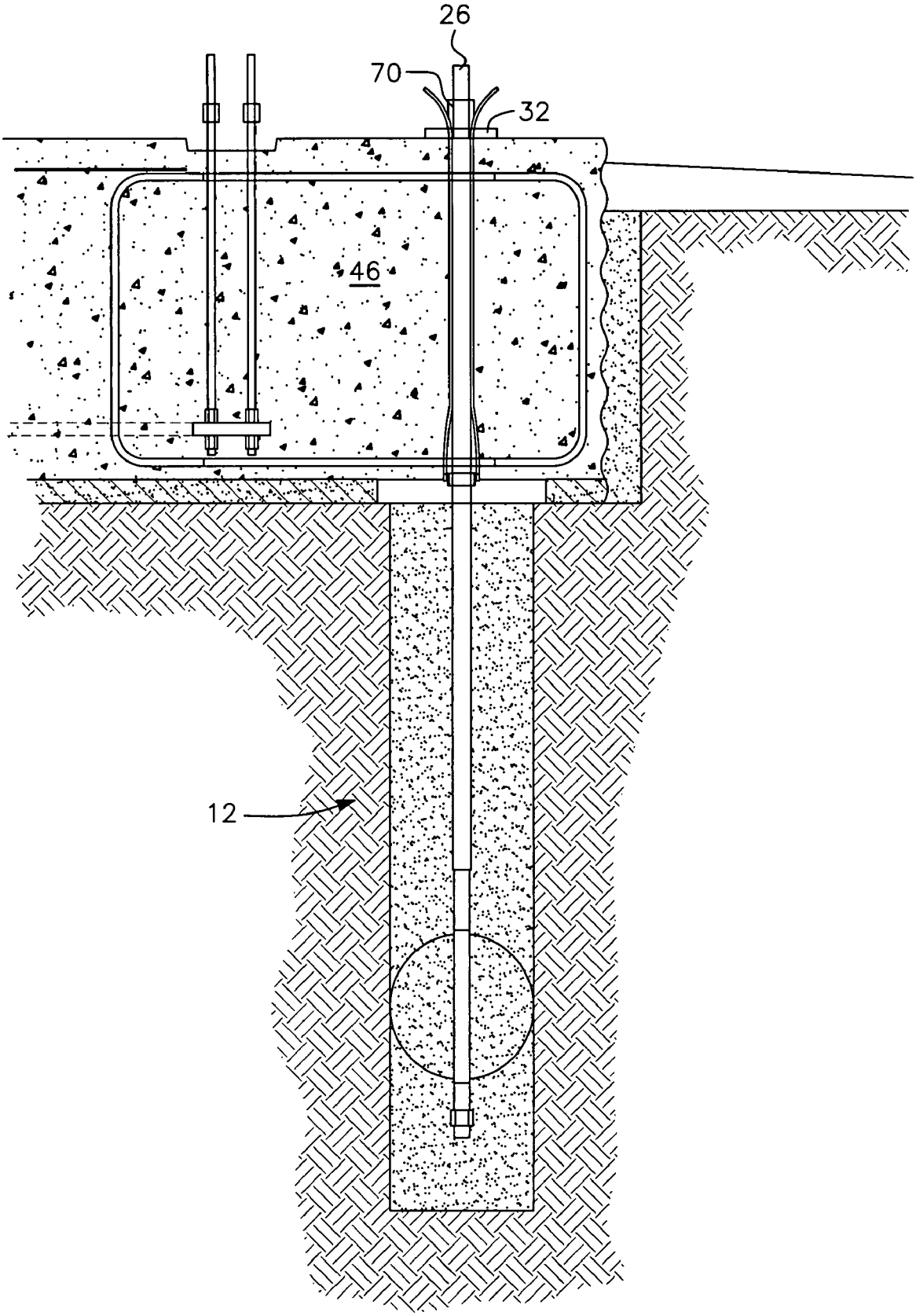
FIG. 8 is a partially sectioned side view of a fourth step in forming the completed foundation following the third step of FIG. 7.

As shown in FIG. 7, the tower anchor bolts 14, embedment ring 22, foundation steel rebar reinforcement 24 and wire mesh 28 are then installed, after which the concrete 46 is poured for the cap foundation 10 within corrugated metal pipe 104. In the representative embodiment illustrated, the cap is 5 feet thick. Following concrete pour and cure of the concrete 46, the pile anchor base plates 32 are installed over the pile anchor bolts 26 atop or preferably grouted into the concrete foundation cap 10 and the post-tensioning nuts 70 are lifted by jacking, or torqued by threading snugly against the pile anchor base plates 32, during the post-tensioning of the pile anchor bolts 26, as illustrated in FIG. 8.

Figure 9:
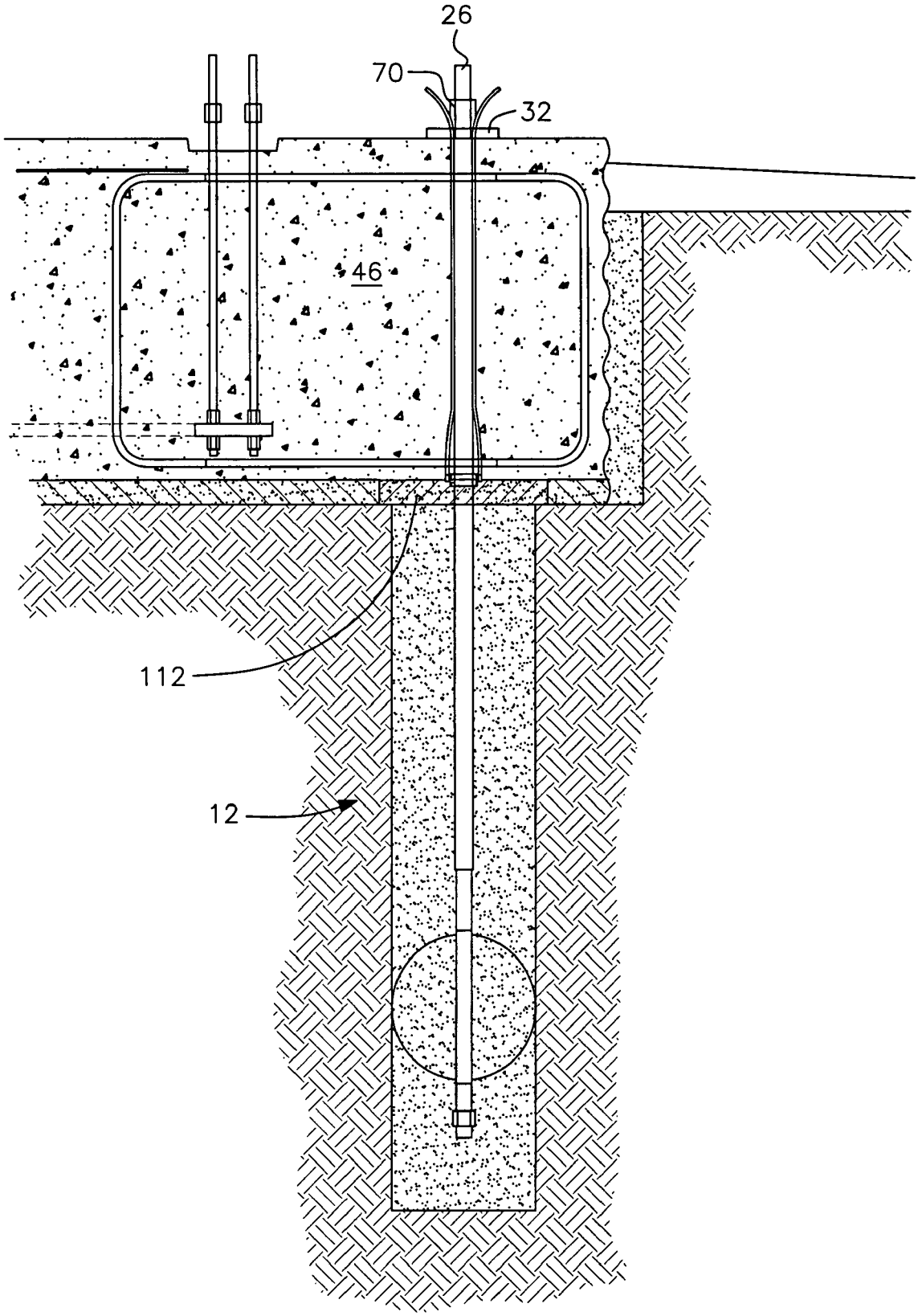
FIG. 9 is a partially sectioned side view of an optional fifth step in forming the completed foundation following the fourth step of FIG. 8.

Finally, if a void forming element 50 with the tube coupler 66 and grout tube 68 construction has been used, pressurized grout can be forced through the inlet grout tube 68 and into any remaining void areas, as at 112 in FIG. 9, not eliminated by the post-tensioning process.

Figure 10:
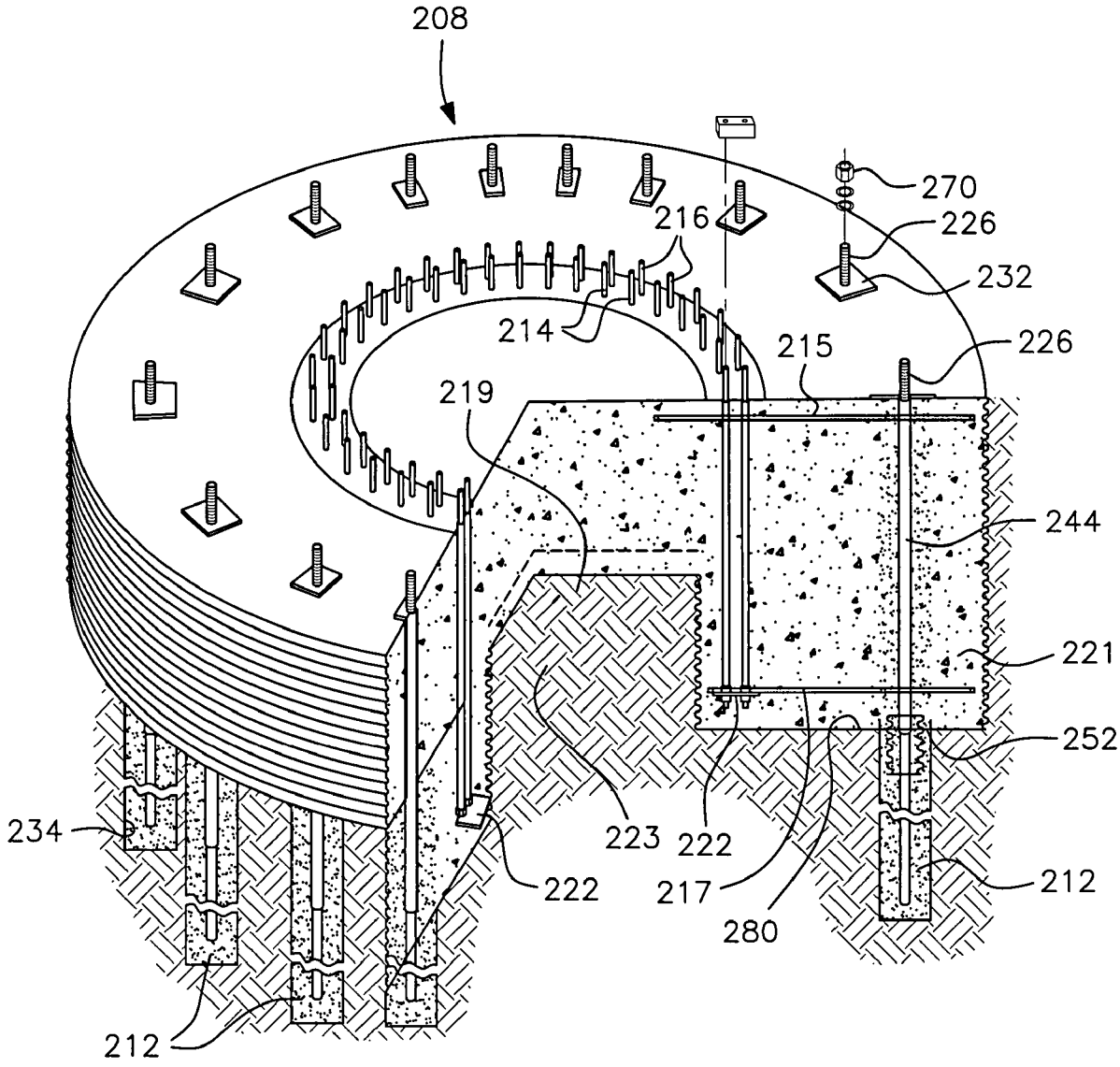
FIG. 10 is a schematic perspective and partial sectional view, similar to FIG. 1, of a complete cap and pile anchor foundation constructed in accordance with a second embodiment of the present invention.
Figure 11:
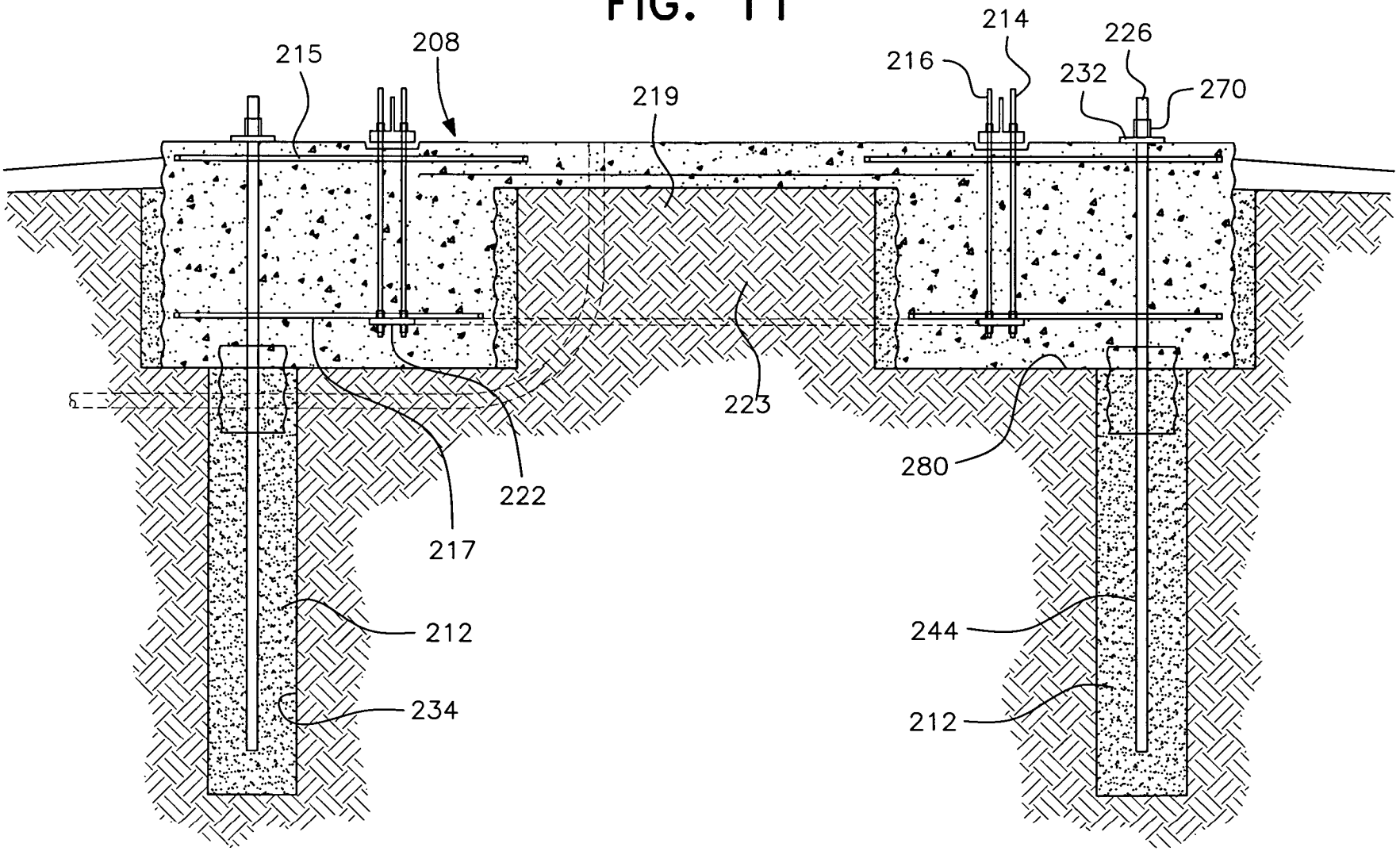
FIG. 11 is a cross-sectional side view of the complete foundation of FIG. 10, similar to FIG. 2.

Turning now to the embodiment of the present invention illustrated in FIGS. 10 and 11, the pile anchor foundation is generally designated by reference numeral 208. Since the components of pile anchor foundation 208 of the second embodiment are identical or very similar to corresponding embodiments of the first embodiment illustrated in FIGS. 1-9, the components will be similarly numbered in FIGS. 10-11 except in the "200" series, i.e., foundation 8 in FIGS. 1-9 and foundation 208 in FIGS. 10-11. There are several differences as described below First, rather than utilizing hoops for the reinforcing steel rebar 24 (as shown in FIG. 2) to resist bending forces, the concrete cap 210 includes horizontal upper bolts or headed rebar 215 and lower bolts or headed rebar 217 extending radially between the tower anchor bolts 214 and 216 at one end and adjacent the pile anchor bolts 226 near their other end. The lower rebar bolts or headed rebar 215 rest on top of the embedment ring 222 and are secured to the sleeve 244 of anchor bolts 226 by rebar hoops, as will be readily understood by those skilled in the art. Similarly, the upper reinforcing steel rebar bolts or headed rebar 217 are secured to the tower anchor bolts 214 and 216, and to sleeve 244 of pile anchor bolt 226 by similar rebar hoops.

Second, it has been found that the central portion of the foundation cap 210 does not have to be the full cap thickness as shown at 219. Hence, the excavation for the foundation cap need only be annular at 221, leaving soil 223 in the central portion 219. Third, it may be desirable to position a corrugated metal pipe 252 in the top of each pile anchor 212, which pipe 252 extends into the bottom of the foundation cap 210. The pipe 252 provides circumferential steel and reduces possible bursting of the concrete at the top of the pile anchor 212.

Advantageously, according to the present invention the pile anchors 12 and 212 of the pile anchor foundation are tension members only. The pile anchors pull the concrete foundation cap 10 and 210 downwardly compressing the underlying bearing soils with such a compression force that the concrete foundation cap is always bearing on the underlying soils even under the greatest overturning and uplift forces transferred to the concrete foundation cap from the tower structure by the tower anchor bolts atop the foundation cap.

As another advantage of the present invention, the pile anchor bolts or tendons 26 and 226 are sleeved as by PVC tubing 44 and 244 to eliminate stress reversals and fatigue while the bolts are stretched by jacking or torquing (post-tensioning). In addition, the post-tensioned pile anchor bolts are shielded from bonding with the reinforced concrete of the concrete foundation cap, allowing the bolts or tendons to elongate when pulled upwardly by jacks or torquing to the required post-tension. The post-tensioned bolts or tendons are secured in tension by a nut 70 and 270 thereon threaded atop the pile anchor base plate 32 and 232 preferably grouted into the top of the concrete foundation cap 10 and 210, thus pulling the cap downwardly with great compression against the underlying soils. Pile anchor bolts or tendons 26 may be re-tensioned periodically as necessary to eliminate long term consolidation and creep.

A further advantage of the present invention is that the pull down/hold down force of the pile anchors 12 and 212 results from post-tensioning of the pile anchor bolts 26 and 226 against the pile anchor base plate 32 and 232 atop or preferably grouted into the concrete foundation cap 10 and 210. The pile anchor 12 and 212 is pulled upwardly toward the adjacent bottom 52 and 252 of the concrete foundation cap until the resisting skin friction against the soil equals the post-tension of the tension bolt centered in the pile hole and restrained by the grout. The post-tension downward force atop the concrete foundation cap should exceed the determined maximum uplift by a factor of 1.5 or greater.

As a result of the foregoing, the post-tensioned pile anchor foundation of the present invention achieves greater rotational stiffness when compared to prior known foundations. The foundation of the present invention also minimizes movement from dynamic forces and increases the foundation frequency to more closely approach that of a rigid body.

As stated previously, the pile anchor base plate 32 and 232 are preferably grouted into the top surface of the concrete foundation cap 10 and 210. This can be readily accomplished by blocking out an indentation slightly larger than the dimensions of the base plate, such as by using a Styrofoam or other easily removable form, similar to making the tower flange grout trough 23. The pile anchor base plate should be grouted into the top surface of the foundation cap so that the upper surface of the base plate coincides with the upper surface of the foundation cap. Having the top surface of the base plate at the same level as the top surface of the foundation cap facilitates using the jacking mechanism when post-tensioning the pile anchor bolts.

The post-tensioned pile anchor foundation of the present invention provides significant flexibility in designing a foundation for a wide range of applications, including variation in the height, weight and overturning moment of the supported tower or other structure, including additional equipment to be supported thereon. This greater flexibility arises from the fact that the number and size of pile anchors can be varied over a wide range, and can even include an inner circle of separate post-tensioned pile anchors if a greater rotational stiffness is required.

The pile holes 34 and 234 and pile anchors 12 and 212 for the concrete foundation 8 and 208 of the present invention can be formed in the soil below the excavation 80 and 280 in a variety of ways and using differing equipment, depending upon the condition of the soil, as known to those skilled in the art. For example, the pile hole 34 may be simply formed by a driven mandrel or formed by a screw auger in generally stable soils, by driven pile pipes or pipes drilled, jetted or vibrated in place in unstable soils, such as in the '281 application, and/or by percussion drilling in rock, or combinations of the foregoing, before positioning the tendon or bolt 26 therein, followed by the addition of the cementious material 36. Alternately, the pile holes may be drilled and the concrete pressure cast with hollow stemmed augers in wet sands and clays or the hole filled with the cementious material through a tube which then serves as the anchor bolt. Other methods and equipment to form the pile anchors known to those skilled in the art can be used without departing from the present invention.

While the utilization of a void or hollow area between the top of each pile anchor cementious material and the adjacent lower surface of the foundation cap, and the utilization of a compressible spacer or void-forming element therefor as described, is clearly preferred for all soil conditions, there may be some circumstances in which the void or hollow area 54 is not absolutely necessary. For example, if the concrete foundation of the present invention has the foundation cap set directly into a rock formation, it may not be necessary to utilize the void or hollow area; the post-tensioning of the pile anchors and foundation cap may be sufficient to achieve the requisite stiffness for the foundation.

Furthermore, while it is clearly preferred to use tower anchor bolts, separate and apart from pile anchor bolts, to attach and support the tower or other supported structure, it may be possible in some circumstances to attach the base flange of the supported tower or other structure directly to the top of the pile anchor bolt.

It should be understood by those skilled in the art that the foregoing description utilizes the terms "concrete" and "cementious material" interchangeably. It will be further understood that various cementious and cementious-type materials can be utilized in constructing the post-tensioned pile anchor foundation of the present invention as would be utilized by those skilled in the art. These materials include, but are not limited to, sand, cement slurrys, grouts, and epoxys.

Further, while the post-tensioning elements and of the present invention have been described as anchor bolts or tendons, those skilled in the art will appreciate that other forms of tension elements, such as cables, rods, pipes, or the like, could be used in accordance with the present invention.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A post-tensioned concrete foundation for supporting on its upper surface a tower or other structure subject to high upset forces which comprises:

a cementious foundation cap for supporting a tower or other structure from an upper surface and having a lower surface;

a plurality of cementious pile anchors spaced from one another and extending downwardly from said foundation cap lower surface into surrounding soil underneath said foundation cap;

a plurality of tensioning elements each having a lower end adjacent and bonded to a bottom portion of a respective one of said pile anchors, and extending upwardly within an elongated sleeve through each said pile anchor and said foundation cap, and terminating at an upper end above said foundation cap upper surface; and a void forming element for creating a void space or highly compressible region between a top of each of said pile anchors and an adjacent portion of said foundation cap lower surface which, upon tensioning of said tensioning elements, allows said foundation cap to move downwardly against soil adjacent said foundation cap lower surface and said pile anchors to move upwardly into said void space or compressible region to at least partly reduce a size of said void forming element.

2. The concrete foundation of claim 1, wherein said void forming element is a molded plastic form or a compressible disc.

3. The concrete foundation of claim 1, wherein said elongated sleeve is made from PVC tubing.

4. The concrete foundation of claim 1, wherein said tensioning elements are solid tendons or bolts.

5. The concrete foundation of claim 1, further comprising an anchor plate surrounding the upper end of each tensioning element and a tension nut threaded onto said upper end to retain elongation of said pile anchor bolts upon tensioning.

6. The concrete foundation of claim 1, wherein said foundation cap is generally cylindrical and said cementious pile anchors with tensioning elements therein are circumferentially spaced around a central axis of said foundation cap.

7. The concrete foundation of claim 1, further comprising a plurality of tower post-tensioning elements each extending between an embedment ring in a lower portion of the foundation cap upwardly through said foundation cap to an upper end projecting above the cap upper surface for engaging a base plate of a tower or other structure to be supported on said foundation cap.

8. The concrete foundation of claim 7, wherein each of said tower post-tensioning elements is encased in an elongated sleeve from said embedment ring to adjacent said respective upper end to permit free elongation of said tower post-tensioning element through said foundation cap upon post-tensioning.

9. The concrete foundation of claim 1, wherein said foundation cap includes reinforcing steel rebar to resist bending forces in the foundation cap.

10. The concrete foundation of claim 1, wherein said void forming element is selected from the group consisting of an open bottom disk, a disk made of expanded polyurethane or styrofoam, an inflatable or pressurized bladder, and any other material that is compressible or crushable under 1 psi pressure.

11. A method for forming a post-tensioned pile anchor foundation for supporting on its upper surface a tower or other structure subject to high upset forces which comprises the steps of:

(a) excavating a hole in a ground surface;

(b) forming a plurality of pile holes in soil below said excavated hole;

(c) suspending an elongated post-tensioning element centrally in each pile hole, said post-tensioning element extending from a bottom portion of said pile hole upwardly above said ground surface;

(d) filling each of said pile holes with a cementious material;

(e) allowing said cementious material in each pile hole to cure and solidify to form pile anchors which bond only with a lower end of a post-tensioning element associated with said pile anchor;

(f) inserting a void forming element on top of said pile anchor cementious material and filling said excavated hole in said ground surface with cementious material so that said void forming element forms a highly compressible region above a top of each pile anchor and below an adjacent bottom portion of said cementious material filling said excavated hole;

(g) allowing said cementious material in said excavated hole to cure and solidify around, without bonding to, said post-tensioning element to form a foundation cap while maintaining said highly compressible region; and (h) tensioning said post-tensioning elements from above said foundation cap to elongate said post-tensioning elements above said lower end and cause said foundation cap to compact downwardly against soil at a bottom surface of said excavated hole and said pile anchors to move upwardly into said highly compressible region to at least partly reduce a size of said void forming element.

12. The method of claim 11, wherein the pile hole is filled with cementious material before the elongated post-tensioning elements are inserted into the pile hole.

13. The method of claim 11, further comprising the step of filling any remaining void space with grout or other cementious material after step (h).

14. The method of claim 11, wherein said excavated hole is circular or annular.

15. The method of claim 11, further comprising the step of suspending tower post-tensioning elements and an embedment ring in said excavated hole after step (e) and before step (f).

16. The method of claim 15, further comprising the step of placing reinforcement rebar in said excavated hole after step (e) and before step (f).

17. A post-tensioned concrete foundation for supporting on its upper surface a tower or other structure subject to high upset forces which comprises:

a generally cylindrical cementious foundation cap having an upper surface and a lower surface;

an embedment ring in a lower portion of said foundation cap;

a plurality of tower post-tensioning elements attached at their lower end to said embedment ring and extending upwardly through said foundation cap to above the cap upper surface for engaging a base plate of a tower or other structure to be supported thereon;

a plurality of cementious pile anchors spaced from one another and extending downwardly from said foundation cap lower surface into soil underneath said foundation cap, each of said pile anchors being individually surrounded by adjacent soil;

a plurality of tensioning elements each having a lower end adjacent and bonded to a bottom portion of a respective one of said pile anchors, and extending upwardly through an upper portion of each said pile anchor and said foundation cap, and terminating at an upper end above said foundation cap upper surface; and said tensioning elements being post-tensioned to cause said foundation cap to compress downwardly against soil adjacent said foundation cap lower surface and cause said pile anchors to respectively pull upwardly and develop skin friction resistance against said adjacent soil.

18. The concrete foundation of claim 17, wherein said tensioning elements are solid tendons or bolts.

19. The concrete foundation of claim 17, wherein said foundation cap is generally cylindrical, with or without a central bottom opening.

20. The concrete foundation of claim 17, further comprising a plurality of void forming elements placed on top of said plurality of pile anchors, respectively, for creating highly compressible regions between a top of each of said pile anchors and an adjacent portion of said foundation cap lower surface, said highly compressible regions, upon tensioning of said tensioning elements, allowing said foundation cap to move downwardly against soil adjacent said foundation cap lower surface and allowing said pile anchors to move upwardly into said respective compressible regions to at least partly reduce a size of said void forming elements and thereby develop skin friction resistance with said adjacent soil.

21. A post-tensioned concrete foundation for supporting on its upper surface a tower or other structure subject to high upset forces which comprises:

a cementious foundation cap for supporting a tower or other structure from an upper surface and having a lower surface;

a plurality of individual cementious pile anchors spaced from one another, each extending downwardly from said foundation cap lower surface into surrounding soil underneath said foundation cap;

a plurality of elongated post-tensioning elements each having a lower end adjacent and bonded to a bottom portion of each of said pile anchors, and extending upwardly through an upper portion of said pile anchor and said foundation cap, and terminating at an upper end above said foundation cap upper surface; and a pile anchor base plate embedded in said foundation cap upper surface for post-tensioning said post-tensioning elements.

* * * * *